United States Patent [19]

Camp, Jr.

[11] 4,182,511

[45] Jan. 8, 1980

[54] EXERCISER DEVICE

[76] Inventor: Hope H. Camp, Jr., 2047 N. Howe St., Chicago, Ill. 60614

[21] Appl. No.: 926,479

[22] Filed: Jul. 20, 1978

[51] Int. Cl.[2] ..... A63B 23/02

[52] U.S. Cl. ..... 272/145; 128/25 R; 5/62; 108/118

[58] Field of Search ..... 272/144, 145; 128/55 R; 5/62; 108/118

[56] References Cited

U.S. PATENT DOCUMENTS

| | | | |
|---|---|---|---|
| 2,240,228 | 4/1941 | Schall | 272/145 |
| 3,034,153 | 5/1962 | Sargent | 108/118 X |
| 3,709,488 | 1/1973 | Garner | 272/145 |
| 3,782,717 | 1/1974 | Berlin | 272/144 |

*Primary Examiner*—Charles E. Phillips
*Attorney, Agent, or Firm*—Thomas F. Peterson

[57] ABSTRACT

An exercizer device is provided which is light weight, portable and collapsible. The device is adjustable to accommodate users of various heights. There is a substantially rectangular frame with two pairs of support legs, one pair being pivotally mounted to the other pair, and the other pair being pivotally mounted to the frame. The frame consists of a pair of generally "U"-shaped members arranged in an opposing and telescoping relationship with securing means to adjust the relative positions between the U-shaped frame members. Across one end of one of the U-shaped members there is a cushion for supporting the lower end of the torso of a human body, while at the other end of the other U-shaped member there is a cross-piece for supporting the feet of the user. One of the pairs of the support legs in assembled position extends beyond the extent of the rectangular frame, whereby the lower portion of a human body can be supported on the frame while the upper portion can extend free and clear of the device to be raised or lowered in completing exercises.

4 Claims, 5 Drawing Figures

FIG. 4
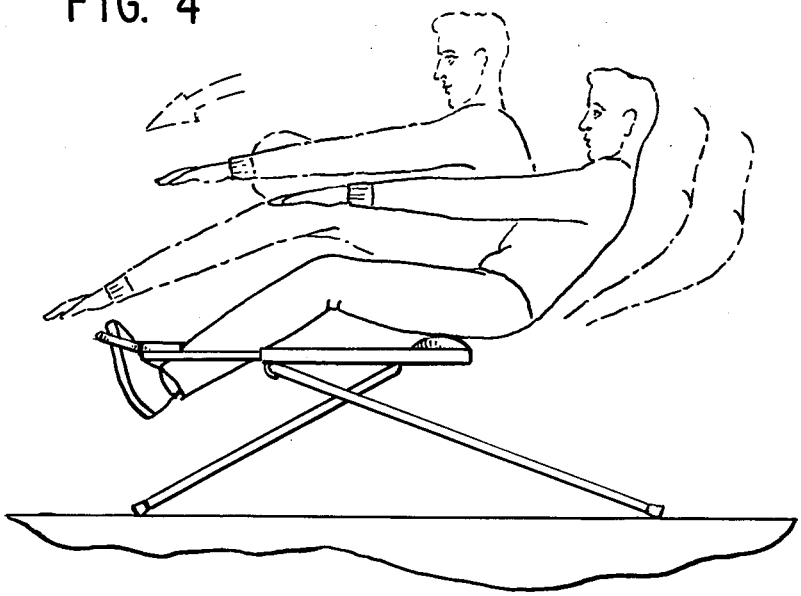
FIG. 2
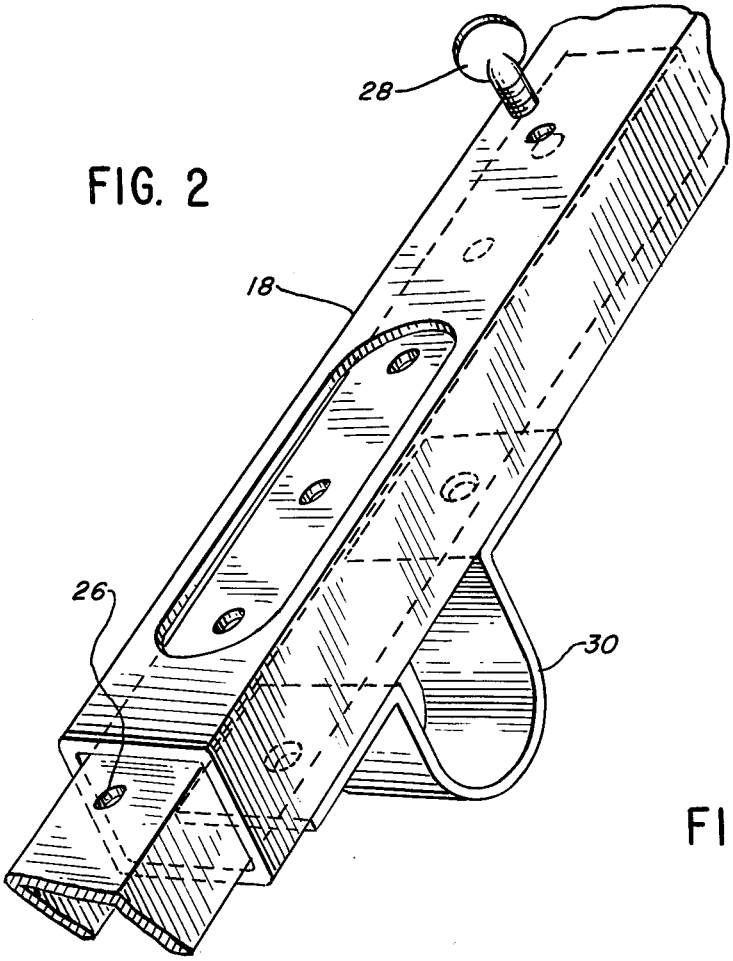
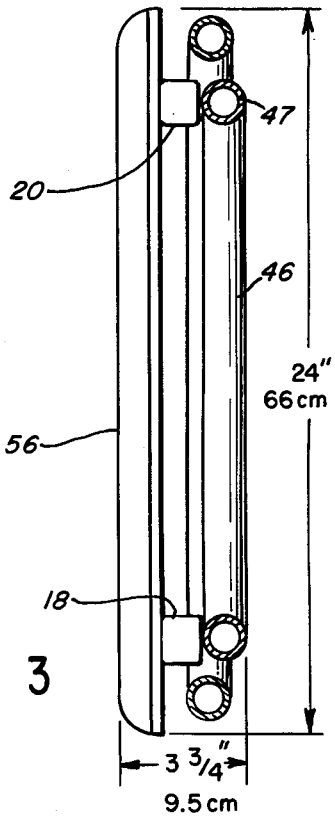
FIG. 3

EXERCISER DEVICE

BACKGROUND OF THE INVENTION

The invention concerns an exercising apparatus particularly useful for home, office or travel of an individual and is designed to enable the user to strengthen lower back and abdominal muscles.

In the past there have been various devices which require cumbersome frameworks and moving parts, and which are not fully collapsible nor portable.

In one such example, a generally rectangular frame includes a seat member which supports a human body with a cross bar to support the feet of the user, but the seat member includes a handle construction and is slidably movable across the framework and is not adapted for enabling the user to strengthen lower back muscles or abdominal muscles. Other rowing type devices are similar in requiring the use of movable parts and are intended to strengthen the upper portion of the user's body rather than the lower back and abdominal muscles.

Examples of prior art devices for exercising, all of which include movable elements, are U.S. Pat. Nos. 3,904,196; 3,473,843; 3,380,737; 3,976,058; and 1,640,150.

SUMMARY OF THE INVENTION

The present invention provides an improved exerciser device which is particularly adapted for use by an executive in his office or during travel, and is intended for use to strengthen the abdominal muscles or lower back muscles without requiring a complex device using movable parts or mechanisms.

The device is entirely portable, light weight and collapsible for easy travel, and is adjustable to accommodate individuals of varying heights.

A rectangular frame adjustable in the lengthwise direction utilizing a cross pad for supporting the hips or lower torso of the individual with a padded cross-member at the opposite end for supporting the feet of the individual. The upper part of the body of the individual user remains free of the device whereby back raises or situps can be accomplished while the lower portion of the body is fully supported by the device.

Two pairs of support legs are provided with one pair being pivotally mounted to the support frame and the other pair being supported pivotally to the first pair. One of the pairs of support legs engages the floor at points beyond the extent of the rectangular frame so as to provide a suitable cantilever support for the individual using the device.

BRIEF DESCRIPTION OF THE DRAWINGS

FIG. 2 is an enlarged perspective view of the adjacent ends of two connected frame members;

FIG. 3 is a schematic end view the device which is disassembled for travel or storage;

FIG. 4 is a schematic side view of the exerciser device in use where the user is performing sit-up exercises; and FIG. 5 is a schematic side view of the exerciser device where the user is performing back-raises.

DETAILED DESCRIPTION

Figure 1:
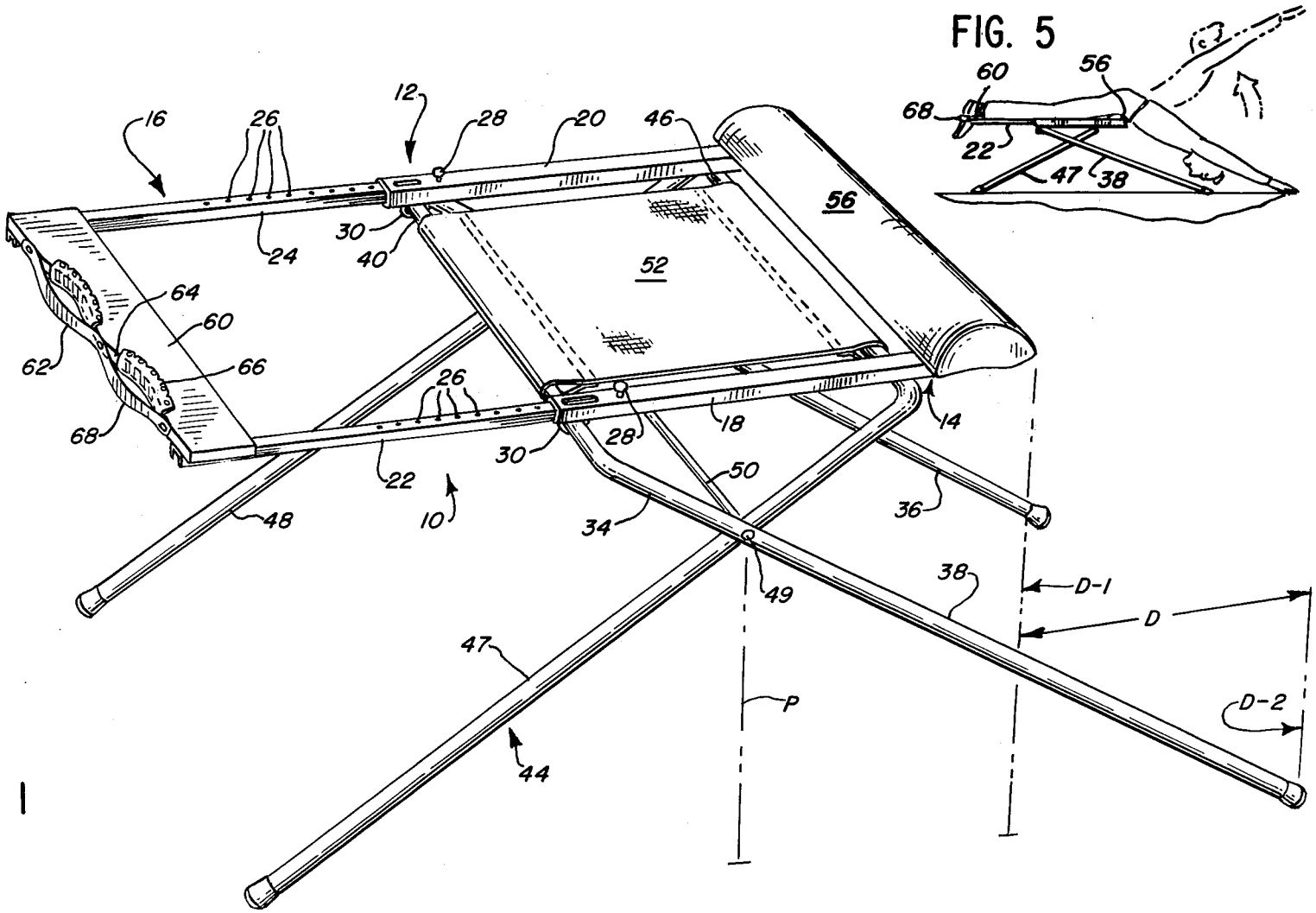
FIG. 1 is a perspective view the exerciser device.

There is shown an embodiment of the invention which is a preferred construction, but from which variations or modifications can be made without departing from the scope of the invention as specifically pointed out in the attached claims.

Referring to FIG. 1, an exerciser device 10 comprises a rectangular frame 12 including a pair of generally U-shaped frame members 14,16 each having a pair of parallel arms 18,20 and 22,24, respectively. In this embodiment, each of the arms 18,20 is formed of a hollow metal bar, having an open end adapted to receive a corresponding arm 22,24 of the U-shaped member 16. The arms 22,24 have a plurality of longitudinally arranged holes 26 for receiving a fastening means to secure member 16 relative to member 14 at any adjusted length. This is accomplished by inserting a pair of fasteners 28, such as locking pins or set screws through one side of the arms 18,20 to engage a selected corresponding pair of holes 26 provided in the arms 22,24 of the frame member 16.

A detailed showing of the end of one arm secured to the other arm is shown in the enlarged perspective view in FIG. 2.

The end portions of each of the arms 18,20 of member 14 also are provided with a pair of retaining means preferably in the form of correspondingly arranged U-shaped brackets 30 adjacent the open end of the arm members 18,20.

In the enlarged view of FIG. 2, an aperture is formed in one wall of the end of arm member 18, to provide access to the interior of the arm end for the purpose of inserting suitable fasteners (not shown) for securing the U-shaped bracket 30 to the opposite wall of the respective end of the arm member 18.

The U-shaped bracket 30 is arranged to accommodate a first support leg member 34 which is pivotally mounted therewith. More specifically, a first support leg 34 comprises a pair of elongated, parallel legs 36,38 rigidly connected by a cross-member 40.

In the illustrated embodiment the legs 36,38 are assembled sections which comprise, with the cross-member 40, the rigid U-shaped support leg 34. Of course, the legs and cross-member could be manufactured as a one-piece, integral leg support. The sections of legs 36,38 can be fabricated with tubular, telescoping insert portions in a typical and well-known manner, not shown in the drawing.

A second, generally similar support leg 44, has an integral cross-member 46 and legs 47,48, and is arranged to complete the support of rectangular frame 12 without need for any intermediate securing means such as additional U-shaped bracket 30. The legs 47,48 can be manufactured in the same manner as described above with reference to legs 36,38.

A pivotal connection 49 secures the first and second support legs 34,44 at an intermediate point of each leg. In the embodiment shown, the pivotal connection is in the form of a connecting cross bar 50 connected between intermediate points of the first and second support legs. Threaded fasteners (not shown) are used to secure the cross bar to the corresponding pivot points 49 of support legs 34,44 to enable relative pivotal movements therebetween.

To control pivotal movements tending to spread the first and second support legs apart, a set 52 made of canvas or other flexible sheet material is utilized to limit the expansion of the support legs in one direction. The seat 52 is formed with portions surrounding the transverse cross-members 40, 46 of the support legs, respectively. The use of a collapsible seat made of canvas or other suitable material will enable the support legs to be collapsed generally parallel to each other while limiting expansion in the assembled condition so as to provide a support for the rectangular frame 12 at a given distance above the floor.

In the assembled condition, the first support leg 34 and its pair of legs 36,38 extend outwardly a distance D beyond the frame member 14, shown between the vertical dotted lines D-1 and D-2 in FIG. 1. The legs 36,38 thereby provide a sufficient support for the rectangular frame to enable the body of a user to extend outwardly beyond the end of the frame 12 in a cantilever fashion, whereby the individual can safely perform various exercises with the movement of the upper portion of the body for strengthening lower abdominal or back muscles, while the lower portion of the torso and legs are fully supported on the device.

A cushioned pad 56 connects the ends of arms 18,20 of the first frame member 14, while across the remote ends of the arms 22,24 is mounted a cross piece 60 with stirrups 62.

The cross piece is preferably formed with concave portions 64 and padding 66 for the user's comfort. A strap 68 can be secured across the remote edge of cross piece 60 to define stirrups 62, which are convenient but not essential.

The user can support his hips or lower end of the torso on the cushioned pad 56 while the feet are supported by cross piece 60. This enables the upper torso of the user to be raised or lowered for exercising stomach muscles, shown in FIG. 4.

The individual user can position himself so that the lower abdominal or stomach muscles are supported by the pad 56 while the feet are supported by the cross piece 60, whereby the user will be facing the floor. Then, as shown in FIG. 5, the upper portion of the torso can be raised or lowered with respect to the floor, while the lower portion of the body is firmly supported with the feet held against the cross piece 60, to enable complementary exercising of lower back muscles.

In both instances of use it is important to understand that the legs 36,38 of the first support leg 34 extend well beyond the extent of rectangular frame 12 to support the human body which, in use, will exert cantilever-like forces with respect to the frame and support legs.

In one constructional example of the embodiment illustrated in the figures, the U-shaped frame member 14 includes a pair of light-weight, parallel tubular metal arms 18,20 which are 30 inches in length and spaced about 17 inches apart. The frame member 15 includes a crosspiece made of wood to which the padding material 56 is secured in any suitable manner. This portion of the frame member is intended to support the lower torso of the human using the device, for example, below the hips. The corresponding arm members 22,24 of the second U-shaped frame member 16 are made of light-weight metal, and spaced apart to cooperate with the first pair of arms. A second crosspiece is secured to connect the remote ends of the second pair of arms, completing the U-shaped frame member 16. This preferably is a length of wood stock with two concave portions of about 4 inches each, cut out to accommodate the heels or the toes of the user, as described above. Covering the concave edges is padding 66 for the comfort of the user. Strap 68 is conveniently fastened at each end and at a mid point to the crosspiece to complete the stirrups 62.

In the preferred embodiment, the parallel arms 18,20 of the U-shaped member 12 are formed of 1 inch square metal tubing, while the parallel arms 22,24 of the second frame member 16 are formed of a corresponding pair of channel-shaped metal bars having a slightly less cross-section to slidably fit within the square tubing of the first frame member in a telescoping relation. Each of the second pair of arms has at least a dozen pairs of corresponding apertures 26 designed to receive fasteners 28. The arms 18,20 of the member 12 each includes a hole 70 to receive a lock bolt or set screw 28 to engage a corresponding pair of opposed apertures 26 in the parallel bars of the second member 16, thereby fixing the rectangular frame 12 to an adjusted length selected by the user.

The assembled pairs of leg members provide support for cantilever-type forces applied by the user to the rectangular frame. More particularly, the first support leg 34 preferably is a one piece U-shaped, tubular metal member with the integral crosspiece 40 about 23 inches long and the integral first pair of support legs about 60 inches long.

The second support leg 44 also comprises a U-shaped one piece metal member having integral crosspiece 46 about 20½ inches long and interconnecting the legs 47,48 which are about 42 inches long.

A flexible material, such as canvas or a like fabric is used for the seat 52 to support the user and is secured in a well known manner between the opposed crosspiece portions 40,46 of each of the support legs to limit the outward or spreading movement to a predetermined position whereby upon being fully extended, the two leg supports will have a generally X-shaped configuration, viewed from the side of the device. However, in view of the different lengths of each of the leg members themselves, the first support leg 34 and its individual legs 36,38 will extend farther away from the rectangular frame supported thereon, than the extent of second support leg 44, providing the necessary support for a user as described above. The selection of the pivot point 49 is chosen so that the legs in the assembled relationship will extend outwardly an uneven distance from the rectangular frame while all four ends of leg members 36,38,47,48 will be firmly planted on the floor. In the example shown, the pivot point 49 is 22 inches above the floor and the first pair of leg members 36,38 extend in one direction about 38 inches from the intersection of a vertical plane P passing through the pivot point 49. The second pair of leg members 47,48 extend in the opposite direction only 22 inches from the vertical plane P.

Overall, the canvas seat and the rectangular frame mounted thereon will be about 30 inches above the floor, a comfortable distance for most uses.

It will be understood, of course, that the individual leg members of each of the support legs can be provided with suitable extensions so that one pair or the other pair or both can be varied in order to adjust the vertical distance of the device from the floor.

It will also be understood that the remote ends of each of the four individual legs can be provided with suitable rubber feet 72 to resist any possible sliding movements.

In FIG. 3 there is shown schematically a collapsed view of the disassembled exerciser device (with brackets 30 removed) to illustrate the compact feature of the invention. As shown the exerciser can be disassembled to fit a container of about 3¾ inches by 24 inches in cross section. The device is completely portable as well as adjustable, and in the collapsed condition the device can be easily transported for use at home, in an office, or at other locations.

FIG. 4 illustrates schematically a human, supported below the torso by the exerciser, and performing sit-ups. By reversing the body position shown in FIG. 4, the user can perform back-raises, shown more particularly in the schematic illustration in FIG. 5. This can be accomplished without readjusting the exerciser in any way and thus provides a convenient manner for performing both types of exercises to strengthen the human torso. It is a particularly important advantage that the device is adaptable for use in the home, or in a hotel room or an office for both sit-ups and especially for back-raises, since ordinarily there is no comparable means by which one could perform back-raises with traditional furniture or surroundings. Further, because of the unique construction and cantilever effect in use, the exerciser will be fully and safely supported.

The extreme lightness and collapsability for easy portability is a further advantage in that the user may transport the device in a collapsed or folded condition, for example, below an aircraft seat, or in other confined quarters without need for special storage or handling.

For convenient use, the cross-bar or footpiece 60 can be provided with padding (not shown) extending across the lower portion and avoiding the need for the stirrups 62, which are in fact not necessary for the uses shown schematically in FIGS. 4 and 5. Thus the feet of the user braced against the cross-piece 60 will provide sufficient leverage and support for both types of exercises described above.

What is claimed is:

1. An exerciser device for conditioning lower back and abdominal muscles, comprising a rectangular frame adapted to support the lower portion of the torso and the legs of an occupant, a pair of support leg means for supporting said rectangular frame, said support leg means including a first pair of support legs pivotally mounted with respect to the rectangular frame and a second pair of support legs pivotally mounted with respect to the first support leg, said rectangular frame including a generally U-shaped first frame member having a pair of parallel arms and a fixed crosspiece, a second U-shaped frame member arranged to be co-planar and opposing said first frame member, with the second frame member comprising a pair of parallel arms arranged in a telescoping relation to the first pair of arms of the first frame member, and the second frame member including a fixed second crosspiece, means securing said opposed ends of said arms of said frame members relative to each other at a selected one of a number of relative positions, flexible means interconnecting said first and second pair of support legs to limit the pivotal movements thereof relative to each other whereby said support legs can be collapsed to a generally co-planar and parallel configuration or can be pivoted to said limit position where said pairs of support leg means provide a planar horizontal support for said rectangular frame.

2. An exerciser device according to claim 1, including a cushioned support pad for supporting the lower torso of a human occupant, said support pad arranged on the crosspiece at one end of one of said U-shaped frame members, the second crosspiece being connected to the remote end of said second U-shaped frame member and including stirrup means adapted for receiving the feet of an occupant.

3. An exerciser device according to claim 1, wherein the arms of said second U-shaped frame member each include a plurality of longitudinally arranged apertures to receive fastening means therein, and the arms of said first frame member are tubular members of a dimension to slidably receive the parallel arms of said second frame member, said first frame member further including fastening means adapted to engage one corresponding pair of said plurality of apertures in the arms of said second frame member whereby to secure said frame members relative to each other at any one of a plurality of relative positions.

4. The exerciser device according to claim 1, wherein said first U-shaped frame member includes a pair of bracket means to accommodate one of said pair of support legs to permit relative pivotal movement between said support leg and said frame member.

* * * * *